US006668506B2

(12) United States Patent
Snauwaert

(10) Patent No.: US 6,668,506 B2
(45) Date of Patent: Dec. 30, 2003

(54) WELDMENT FOR INTERCONNECTING SLABS OF PRE-CAST CONCRETE

(76) Inventor: Robert M. Snauwaert, 9419 Dixie Hwy., Fairhaven, MI (US) 48023

( * ) Notice: Subject to any disclaimer, the term of this patent is extended or adjusted under 35 U.S.C. 154(b) by 0 days.

(21) Appl. No.: 09/884,321

(22) Filed: Jun. 19, 2001

(65) Prior Publication Data

US 2002/0192018 A1 Dec. 19, 2002

(51) Int. Cl.[7] ..... E04B 2/00

(52) U.S. Cl. ..... 52/583.1; 52/582.1; 52/601; 52/715; 52/712

(58) Field of Search ..... 52/582.1, 583.1, 52/601, 715, 712

(56) References Cited

U.S. PATENT DOCUMENTS

| | | | | |
|---|---|---|---|---|
| 1,280,485 A | | 10/1918 | Kahn | |
| 2,188,445 A | | 1/1940 | Saxe | 189/36 |
| 2,607,450 A | | 8/1952 | Horowitz | 189/36 |
| 2,611,262 A | | 9/1952 | Dodson, et al. | 72/42 |
| 2,644,740 A | | 7/1953 | Cochrane | 72/107 |
| 3,359,022 A | | 12/1967 | Russell | 287/189.36 |
| 3,585,711 A | | 6/1971 | Hicks | 28/492 |
| 3,683,578 A | | 8/1972 | Zimmerman | 52/274 |
| 3,958,954 A | | 5/1976 | Ehlenbeck | 29/183.5 |
| 3,993,341 A | | 11/1976 | Bentley | 294/89 |
| 4,724,649 A | | 2/1988 | Lowndes, III | 52/583 |
| 4,930,677 A | | 6/1990 | Jolliffee | 228/120 |
| 5,222,338 A | | 6/1993 | Hull et al. | 52/405 |
| 5,402,616 A | * | 4/1995 | Klein | 52/715 |
| 5,485,704 A | | 1/1996 | Sandor, Sr. | 52/584.1 |
| 6,065,263 A | | 5/2000 | Taguchi | 52/583.1 |
| 6,185,897 B1 | * | 2/2001 | Johnson et al. | 52/582.1 |

* cited by examiner

*Primary Examiner*—Carl D. Friedman
*Assistant Examiner*—Nahid Amiri
(74) *Attorney, Agent, or Firm*—Gifford, Krass, Groh, Sprinkle, Anderson & Citkowski, P.C.

(57) ABSTRACT

A weldment connector for use with castable concrete slabs, each of the slabs including a length, width and depth and having at least one opposing and extending edge. The weldment connector has a substantially elongated and planar shaped front face and first and second legs which are both integrally formed with and extend from opposite end locations of the front face. The legs further extend in a combined axial and rotationally offset fashion relative the front face and so that, upon being embedded within a first selected slab of concrete with front face extending in exposed fashion along its extending edge, the construction of the legs exhibits greater resistance to cracking. In use, a second weldment connector is likewise embedded within a second selected slab of concrete in similar fashion and so that its corresponding front face extends along an opposing extending edge, in proximate fashion relative to the front face of the first weldment connector. A conventional weldment, such as is provided by an electric weld gun, secures together the front faces of the first and second connectors. In use, the weldment connectors act to redistribute, within the interior body of each concrete slab, load forces applied along its common seamed edge.

10 Claims, 6 Drawing Sheets

WELDMENT FOR INTERCONNECTING SLABS OF PRE-CAST CONCRETE

BACKGROUND OF THE INVENTION

1. Field of the Invention

The present invention relates generally to concrete weldment connectors and, more particularly, to an improved concrete weld clip for interengaging seam edges of first and second slabs of pre-cast concrete, and in particular for use with pre-fabricated concrete used in deck structures and the like. The weldment connector of the present invention in particular provides an improved construction which permits its use with shallower concrete forms than which is possible with prior art weldments. Additionally, the weldment connector of the present invention includes first and second extending leg constructions which are both rotationally offset and configured to increase and more evenly distribute, across the entire slabs, loading forces applied directly to the seam.

2. Description of the Prior Art

Weldment clips are well known in the art for interconnecting succeeding slabs of pre-cast concrete along a seamed edge. The purpose of such clips (also known as weldments or flange connectors) is to redistribute, into the interior of the concrete slabs, forces directed to the seamed edges (such as by vehicles traveling upon a parking deck structure). In the absence of such weldment clips, the concrete slabs would quickly crack, buckle and fracture along their seam edges.

A first example of such a prior art flange connector is illustrated in U.S. Pat. No. 6,185,897, issued to Johnson et al., and which adjoins adjacent concrete structural members. The flange connector discloses a one-piece steel member having a faceplate, opposing faceplate returns arranged at a 90° angle relative to the faceplate, succeeding and flattening bend portions and, finally, substantially planar and extending legs which terminate in perpendicularly configured reinforcing tabs.

The flange connector of Johnson, while disclosing a substantially functional weldment, has been found not to be practical for use with many pre-cast concrete forms of shallower depth and due to the cross sectional height of the front faceplate. Additionally, the construction of the first and second legs extending from the faceplate, and by virtue of the intermediate faceplate returns and flattening bends, have been found in practice to bend or crack under severe loading conditions. Further, the provision of the perpendicularly arrayed and end reinforcing tabs are disclosed as having holes formed therethrough for receiving a flexingly inserted and reinforcing steel bar. However, it has further been found in practice that the bending of such terminating edge portions of the weldment clip legs have the opposite effect of localizing the pressure forces applied along the seamed edge, and opposed to the desired effect of distributing such forces throughout the substantial interiors of the concrete slabs.

A further example of a concrete weldment and method of manufacture is disclosed in U.S. Pat. No. 5,402,616, issued to Klein. The weldment again includes a central plate having a planar, weldable surface along an edge of the concrete slab, the weldable surface being perpendicularly disposed to the horizontal plane of the concrete slab. A pair of outstanding arms extend, in substantially planar fashion, from the weldable surface and are embedded in the concrete slab. The outstanding arms have a constant height across their length and support a steel reinforcing mesh at a predetermined height during the concrete slab casting operation. A blockout is provided to the mold during the casting operation to keep the top edge and front surface of the weldable surface free and clear of concrete and both provides for thermal expansion of the weldable surface to minimize cracking and spalling during welding, as well as being removed (so as to be removable) from the mold after the concrete has hardened.

U.S. Pat. No. 3,958,954, issued to Ehlenbeck, discloses a weldment for embedment along the edges of concrete members and to permit welding joinder of adjacent members. The weldment is formed of sheet steel and includes an elongated central portion which is exposed when the weldment is emplaced. The central portion terminates in fold lines from which extend tapered tails that are embedded in the material. The fold lines are angularly displaced in a generally converging fashion and the tails are bent out of the plane of the central portion.

U.S. Pat. No. 4,930,677, issued to Jolliffee, teaches a concrete connector for a concrete structure and having two generally flat plates connected together along one edge to form an elongated structure having a substantially "L" shaped cross section. One plate is sized with an opening to allow unset concrete to flow therethrough and to hold the plate firmly within the concrete when it is set. The other plate protrudes from the set concrete and is available for connection with another and similar such connector by direct welding or clamping of the two plates together.

U.S. Pat. No. 4,724,649, issued to Lowndes, III, teaches another type of side weld plate, similar in respects to that previously described in Jolliffee and which includes an elongated body with a body section embedded in a concrete slab. An interconnecting flange section of the weld plate is positioned adjacent an edge of the concrete slab and so that the flange section provides an exposed weld surface which allows for adjacent concrete slabs also having a side weld plate to be welded together.

SUMMARY OF THE PRESENT INVENTION

The present invention is a weldment connector which is an improvement over prior art connectors in that it permits use with shallower concrete forms than possible with prior art weldments. Additionally, the weldment connector of the present invention includes first and second extending leg constructions which are both rotationally offset and configured to increase and more evenly distribute, across the entire slabs, loading forces applied directly to the seam. The configuration and construction of the extending legs also renders them more resistant to cracking than has heretofore been experienced with other prior art types of weldment connectors.

The construction of parking deck structures, or other suitable concrete supported foundations, is well known in the art and typically includes a suitable pattern or form within which the concrete is poured and set. It is desirable to pre-mount a plurality of individual weldment connectors in spaced apart fashion along one or both of the elongated extending edges of the form and prior to pouring concrete.

Each weldment connector includes a substantially elongated and planar shaped front face having a specified length, width and height. First and second legs are integrally formed with and extend from opposite end locations of the front face. The legs each have a height and thickness substantially equal to that of the front face and extend in both a desired angular orientation relative to an axis extending axially through the front face, as well as extending in a combined axial and rotationally offset fashion so that so that, upon being embedded within a first selected slab of concrete with its front face extending in exposed fashion along its extending edge, the construction of the legs exhibits greater resistance to cracking.

In use, a second weldment connector is likewise embedded within a second selected slab of concrete in similar fashion and so that its corresponding front face extends along an opposing extending edge, in proximate fashion relative to the front face of the first weldment connector. A conventional weldment, such as is provided by an electric weld gun, secures together the front faces of the first and second connectors. In use, the weldment connectors act to redistribute, within the interior body of each concrete slab, load forces applied along its common seamed edge.

An additional feature provided by the weldment connectors of the present invention include the provision of undulated portions at terminating end locations of the first and second legs. The undulated portions create a ripple or billowing effect in the associated legs, the result of which is that they better grip the surrounding concrete (in similar fashion to the bent edges 28 of Johnson U.S. Pat. No. 6,185,897) while at the same time substantially functioning in the desired fashion to direct, within the interior of the associated concrete slab, load forces applied along the seamed and interconnecting edge.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENT

Referring now to FIGS. 1, 2, 3 and 7, successive perspective, frontal, side and top views are shown of the weldment connector 10 according to the first preferred embodiment of the present invention. As described previously, the weldment connector is an improvement over prior art connectors in that it permits use with shallower concrete forms than possible with prior art weldments.

Figure 6:
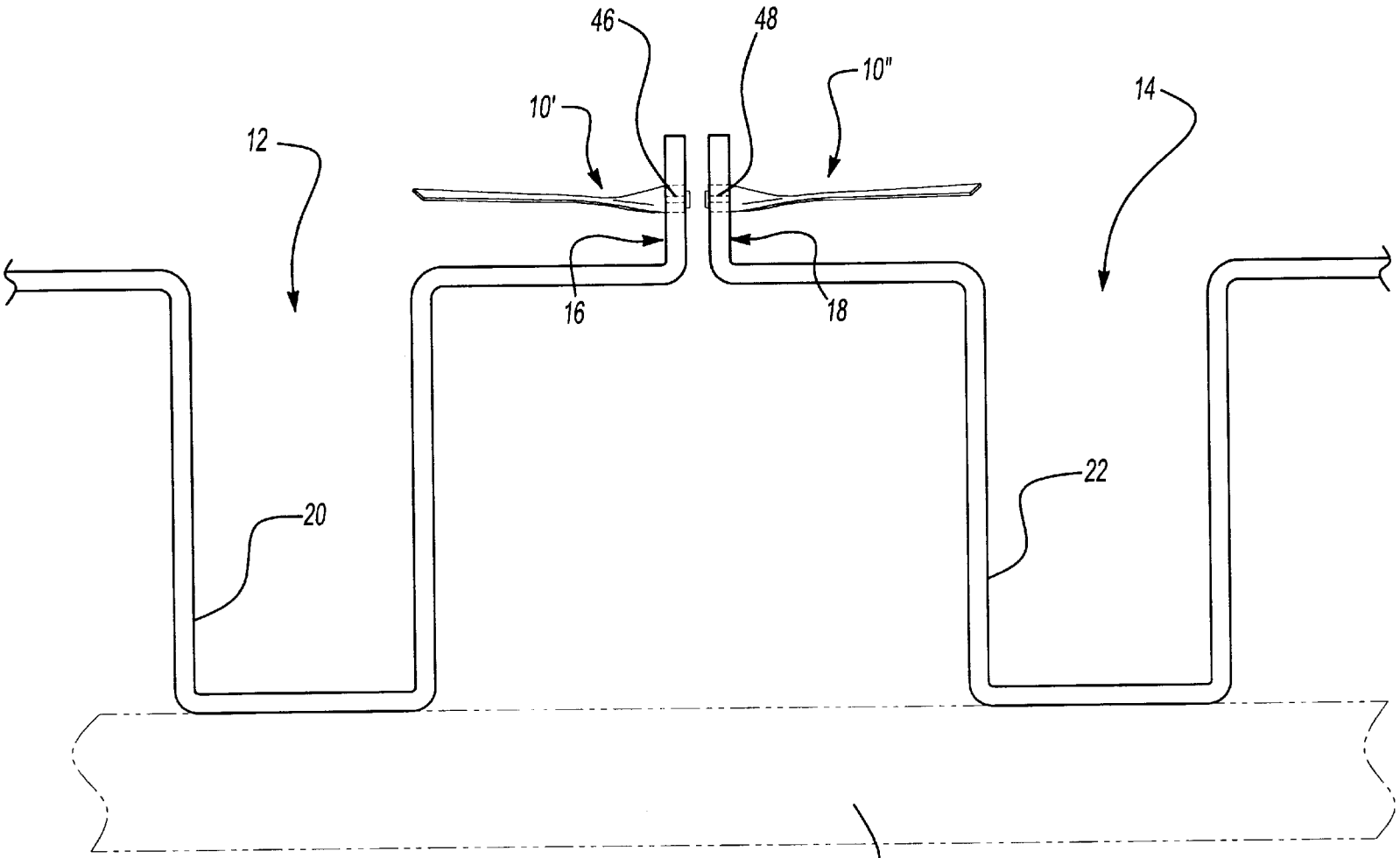
FIG. 6 is a side cutaway and illustrating a desired configuration of pre-cast concrete form patterns and further evidencing the applicability of the weldment connector according to the present invention.

Examples of such forms are illustrated at 12 and 14 in the side cutaway of FIG. 6 and for arraying first and second weldment connectors (see in phantom at 10' and 10"). Each form includes an upper stepped portion (see at 16 and 18 for forms 12 and 14, respectively) and a lower foot portion (see at 20 and 22). A distinct advantage achieved by the weldment connectors 10 according to the invention is its ability to fit within the fairly shallow confines of the upper stepped portions (again at 16 and 18) of the forms 12 and 14 during casting of the concrete. A disadvantage encountered with prior art weldment connectors surrounds the excessive height of its associated front face (see again Johnson '897, Klein '616 and Ehlenbeck '954) and which thereby limits its use to other and certain forms which possess a deeper upper stepped portion (not shown).

Referring again to the previously referenced FIGS. 1, 2, 3 and 7, the weldment connector 10 is preferably constructed of a high grade steel material or, alternatively, can be constructed of any other suitable material exhibiting the necessary properties of strength and durability. The connector 10 includes a substantially elongated and planar shaped front face 24 having a specified length, width and height and which, as previously described, is configured for easily fitting within the confines of the upper stepped portions (16 and 18) of the forms 12 and 14 illustrated in FIG. 6.

Figure 8:
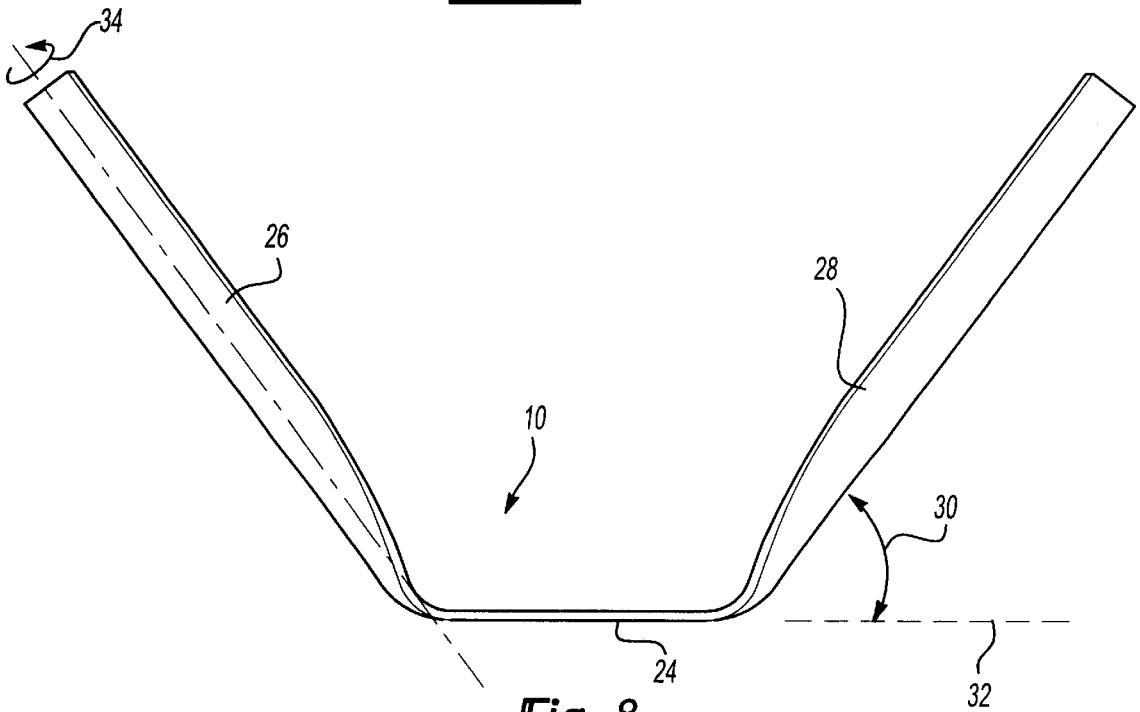
FIG. 8 is a top view illustration of the weldment connector.

The weldment connector 10 of the present invention further includes first and second extending leg constructions 26 and 28. As best illustrated in the overhead view of FIG. 8, the legs 26 and 28 each extend at a desired angle (typically between 45° to 60° as referenced by arrow 30) relative to an axis 32 extending in an axial direction through the front face 24. An additional and significant feature of weldment connector 10 further contemplates the combined axially and torsional/rotationally offset relationship of the legs 26 and 28 relative to the front face 24. In one preferred application, the terminating and flat planar surfaces of the legs 26 and 28 rotatively extend up to between 70° to 75° (see arrow 34) relative to the front face 24. In the preferred embodiment, the legs 26 and 28 share a common height and thickness and such that the weldment connector 10 can be manufactured, in a suitable bending or forming operation, from a substantially straightened piece of metal stock.

Figure 1:
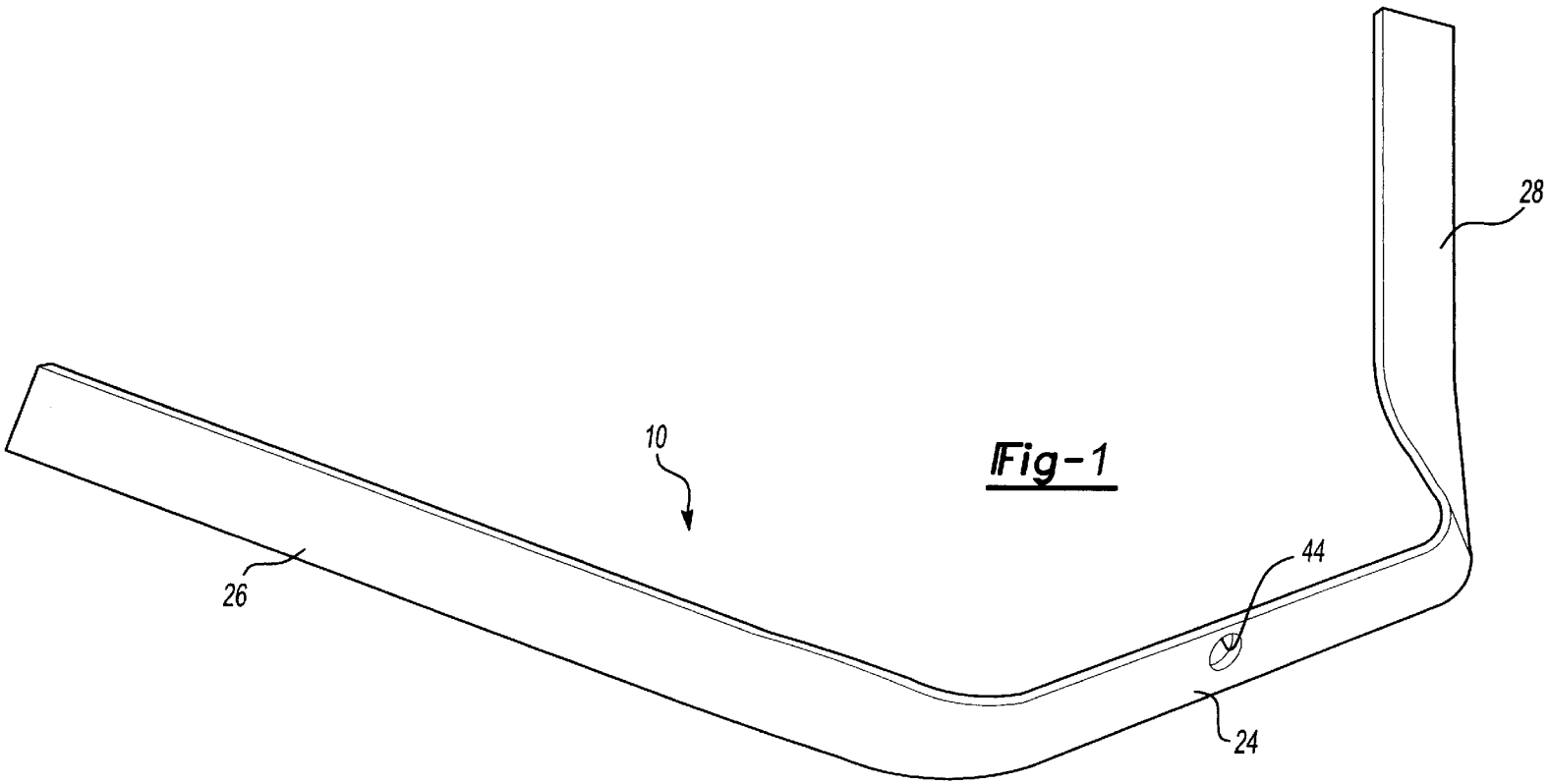
FIG. 1 is a perspective view of the weldment connector according to a first preferred embodiment of the present invention.
Figure 2:
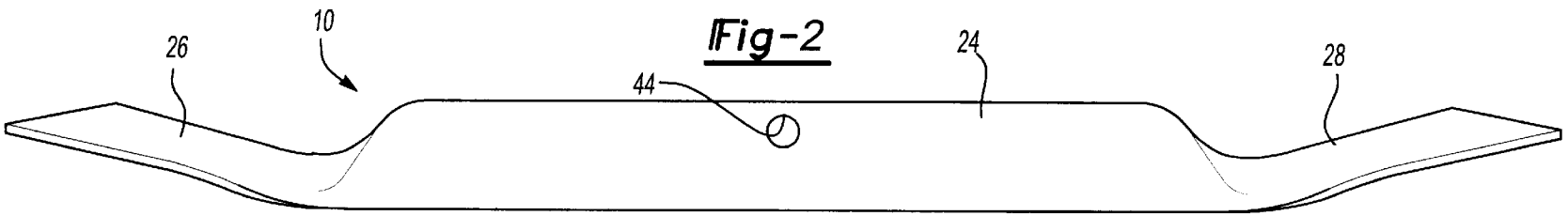
FIG. 2 is a frontal view of the weldment connector illustrated in FIG. 1.
Figure 3:
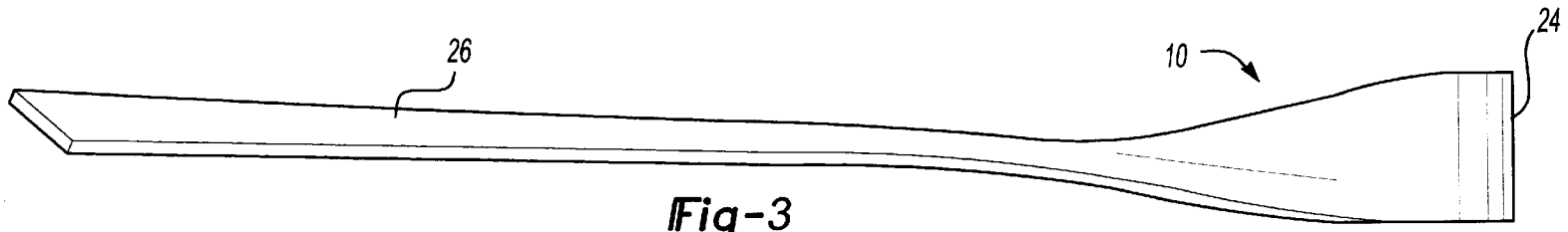
FIG. 3 is a side view of the weldment connector.
Figure 4:
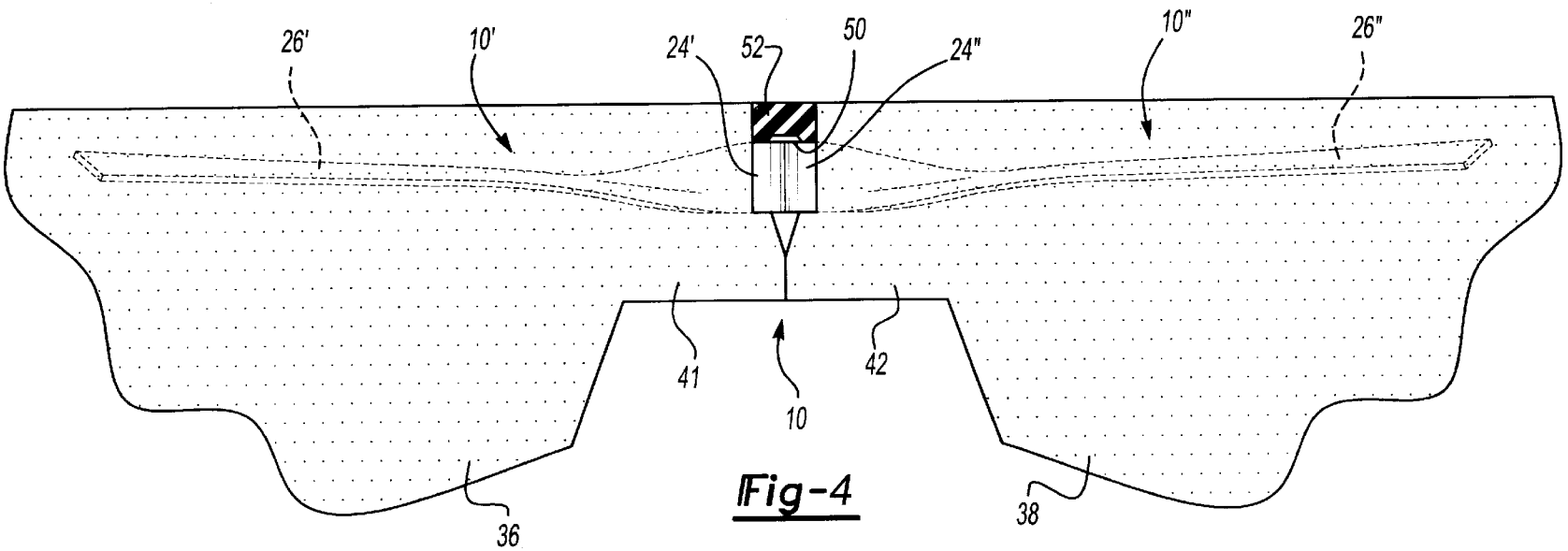
FIG. 4 is an environmental view, in side cutaway, and illustrating an edge-seam connection between first and second pre-cast slabs of concrete with associated and interengaged first and second weldment connectors.
Figure 5:
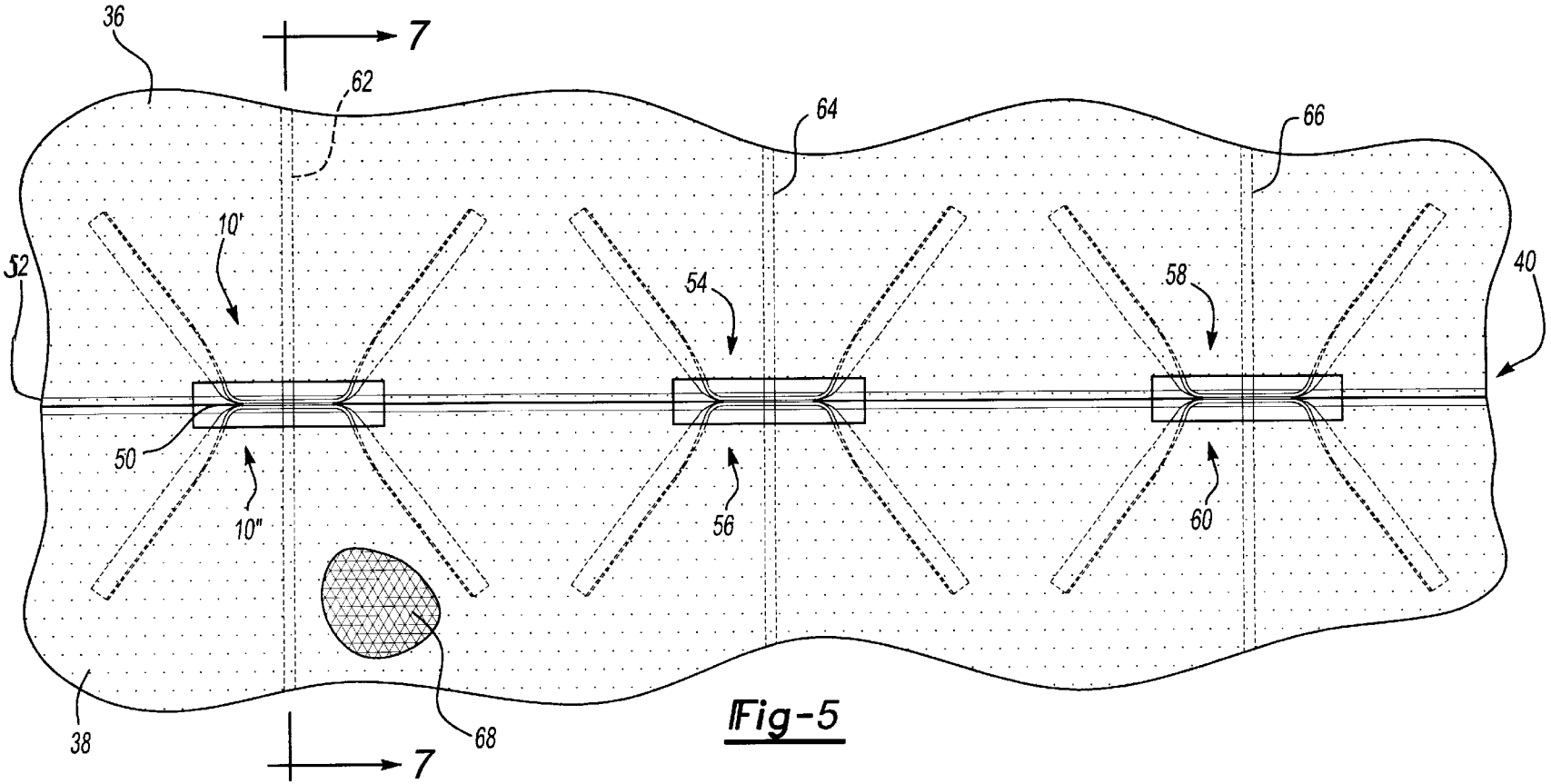
FIG. 5 is an overhead illustration of the environmental view shown in FIG. 4 and illustrating a plurality of interengaged pairs of weldment connectors according to the present invention.
Figure 7:
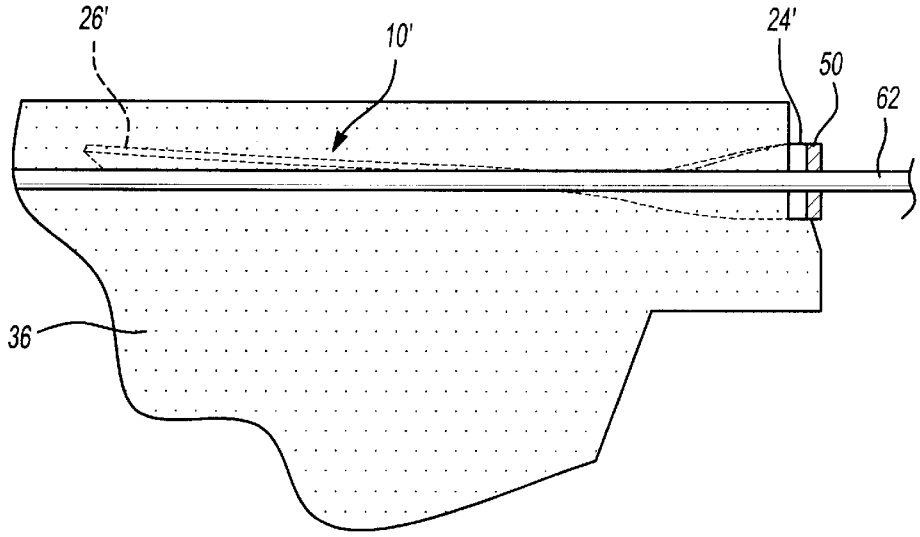
FIG. 7 is a cutaway view taken along line 7—7 of FIG. 5 and illustrating, in phantom side profile, the elongate extending and rotationally offset legs embedded within the associated concrete section.

Referring again to the drawing figures previously described, as well as succeeding FIGS. 4, 5 and 7, a plurality of individual weldment connectors are contemplated to be situated along either or both extending edges of the castable concrete slabs. Referring first to FIG. 4, first 36 and second 38 slabs of concrete are referenced in opposing and axially extending relationship and so that the slabs share a common extending edge 40. The slabs 36 and 38 may be cast from forms as previously illustrated at 12 and 14 and so that they each include an upper stepped portion (41 and 42) which define parts, respectively, of the slabs 36 and 38.

Each weldment connector 10 further includes an aperture defined by an interior and annular extending perimeter 44 formed in the front face 24 of the connector 10. The purpose of the aperture 44, as best illustrated again in the side illustration of FIG. 6, is to facilitate the mounting of the weldment connectors, see again in phantom 10' and 10") to associated and opposing locations in the upper stepped portions 16 and 18 of the forms 12 and 14, during the pouring/casting stage of the concrete slabs and this is further accomplished through the use of mounting fasteners or the like (see further at 46 and 48).

Referring again to FIG. 4, the side cutaway and assembled view illustrates the selected pair of weldment connectors 10' and 10" in opposing and aligning fashion. This is accomplished by the legs of the first weldment connector 10' (see leg 26' in side profile) being embedded within the first selected slab of casted concrete 36 so that its associated front face 24' extends in exposed fashion along its selected side of the common extending edge 40 (see also side cutaway of FIG. 7). The second weldment connector 10" is likewise embedded within the second selected slab of casted concrete 38, in like fashion, and so that its front face 24" extends in corresponding exposed and opposing fashion along the edge common abutting edge 40 and proximately/alignigly with the front face 24' of the first weldment connector 10'.

Upon casting and removing the concrete slabs 36 and 38 from their associated forms (see again at 12 and 14), and with their respective pluralities of weldment connectors in place (referenced in FIG. 4 by only the pair 10' and 10" of opposing connectors), the slabs are arranged in their desired spaced and opposing relationship such that the front faces 24' and 24" of the connectors 10' and 10", respectively, are aligned. The slabs are then securably interengaged with one another, such as through the application of a weldment 50 (FIG. 4). A covering is provided over the seamed edge 40 of the concrete slabs 36 and 38 and this is typically accomplished by the provision of a caulk joint 52 or other suitable filling/covering material which is flowably introduced into the exposed depth of the seamed edge.

Additionally, and referring to the overhead illustration of FIG. 5, spaced apart pairs of weldment connectors (see again first pair at 10' and 10", as well as succeeding pairs 54 & 56 and 58 & 60) are provided at spaced apart and exposed locations along each opposing and exposed edge (making up common edge 40) of the first 36 and second 38 slabs. The individual pairs of weldment connectors are each arranged and secured together in similar fashion as previously described and additional inter-engaging support is provided the seamed edge 40 of the concrete slabs 36 and 38 in the form of a plurality of spaced apart and parallel extending reinforcing bars 62, 64, 66, et. seq., and a wire meshing 68 embedded within and extending therebetween the first and second slabs of concrete.

Referring back to FIG. 6, underside supporting beams (see at 70) are provided for supporting the underside of the casted concrete structures. It should be further noted that, with reference to FIG. 6, this is a diagrammatic illustration of portions of the forms 12 and 14 (and not the actual completed slabs which are produced by the forms and as are illustrated in 36 and 38 in FIGS. 4 and 5); accordingly the arrangement in FIG. 6 with the illustration of the beam support 70 is intended primarily for pointing out the secondary and supporting applications of the assembled deck structure according to the preferred embodiment of the present invention.

The construction of the legs 26 and 28, as specifically provided by their combined angular extending and rotative offset, enables the weldment connectors to both increase and more evenly distribute, across the entire slabs, loading forces applied directly to the opposing seam. The configuration and construction of the extending legs also renders them more resistant to cracking than has heretofore been experienced with other prior art types of weldment connectors.

Figure 9:
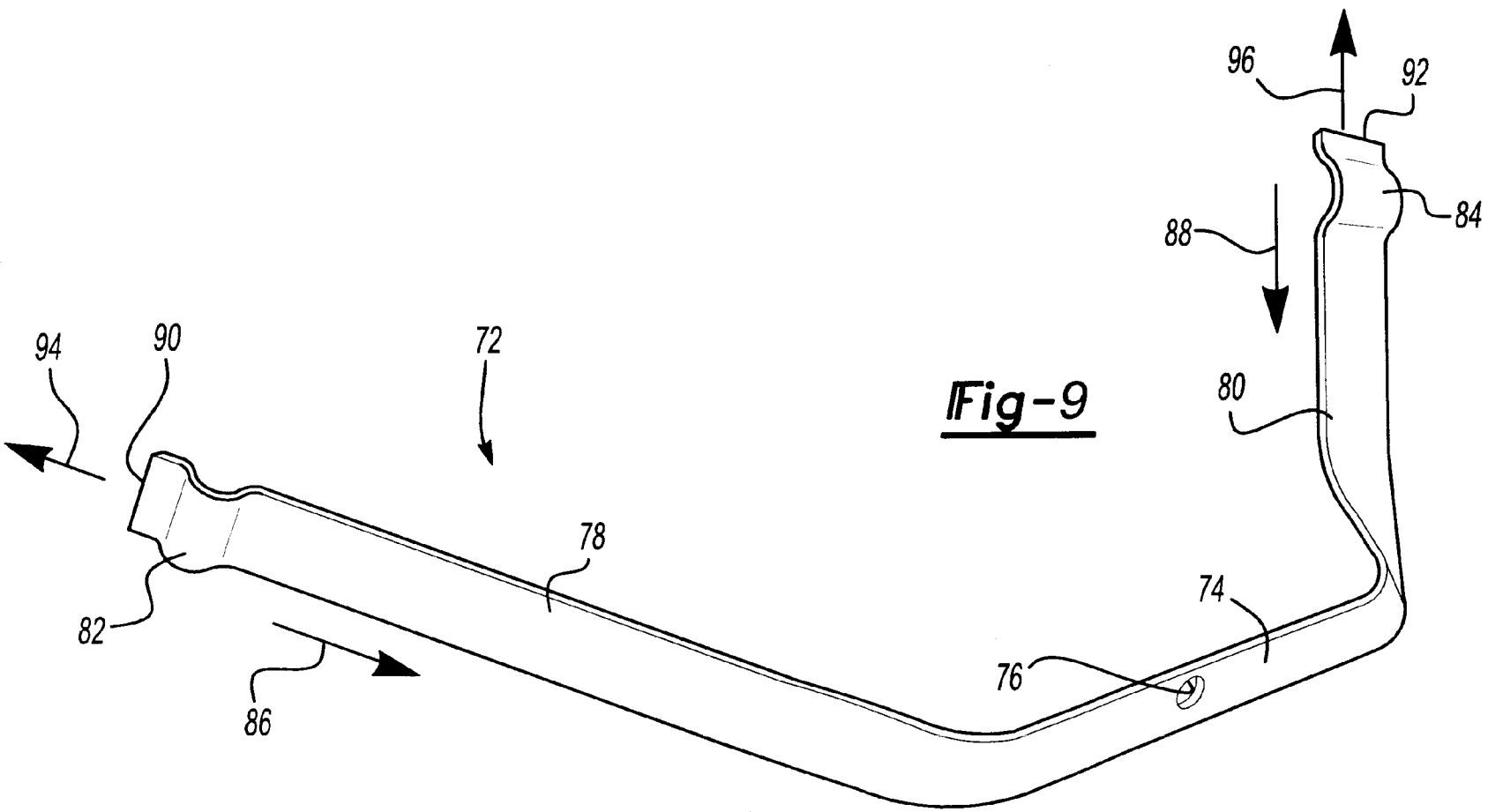
FIG. 9 is a perspective view of the weldment connector according to a second preferred embodiment of the present invention and illustrating undulated portions at terminating end locations of the first and second legs.

Referring finally to FIG. 9, a further modification 72 of a weldment connector is illustrated and which, similarly to that illustrated and described previously at 10, again includes such features as a substantially elongated and planar shaped front face 74, interiorly formed aperture 76, and first 78 and second legs 80. The legs 78 and 80 are generally configured and shaped in the fashion as previously described at 26 and 28 in the first preferred embodiment, with the difference that terminating end locations of each leg are further defined by an undulated portion (82 for leg 78 and 84 for leg 80). Each undulated portion 82 and 84 is in the general shape of a ripple, billow or wave in the configuration of its associated leg 78 and 80 and the purpose of the undulated portions is to provide enhanced gripping of the surrounding and casted concrete slabs (to thereby prevent the legs from wanting to disengage in directions indicated by arrows 86 and 88 in response to loading forces applied onto the seamed edges). The undulated portions 82 and 84 further terminate short of the exposed and planar extending/rotatively offset edges of the legs 78 and 80 (see at 90 and 92, respectively) and so that the above referenced loading forces are directed from the terminating leg ends 90 and 92 towards the massive interior of the slabs (such as at 36 and 38) and further referenced by inward directional arrows 94 and 96.

Having described my invention, additional preferred embodiments will become apparent to those skilled in the art to which it pertains and without deviating from the scope of the appended claims.

I claim:

1. A weldment connector for use with castable concrete slabs, each slab including a length, width and depth and having at least one opposing and extending edge, said weldment connector comprising:

a substantially elongated and planar shaped front face; and first and second legs integrally formed with opposite end locations of said front face, said legs extending in both a combined and continuous axial and rotationally offset fashion relative said front face, said legs further comprising undulated portions at terminating end locations thereof;

said legs of a first weldment connector being embedded within a first selected slab of concrete so that said front face extends in exposed fashion along its extending edge, a second weldment connector being embedded within a second selected slab of concrete in like fashion and so that its front face extends along a corresponding and opposing extending edge in proximate fashion relative to said front face of said first weldment connector, said front faces of said first and second weldment connectors being inter-engaged to thereby inter-engage the concrete slabs and such that said legs evenly distribute, across the entire slabs, loading forces applied directly to the opposing extending edge.

2. The weldment connector as described in claim 1, further comprising said first and second legs rotatively offsetting within a range of 70° to 75° relative said front face.

3. The weldment connector as described in claim 1, said weldment connector having a specified length, height and thickness and being constructed of a high grade steel material.

4. The weldment connector as described in claim 2, further comprising said front face and said first and second legs having a common height and thickness.

5. The weldment connector as described in claim 2, further comprising said first and second legs angularly offsetting at a range of between 45° to 60° relative to an axis extending an axial direction along said front face.

6. The weldment connector as described in claim 1, further comprising an aperture formed through said faceplate to permit said weldment connector to be fastened to a supporting frame when pouring the associated pre-cast concrete slab.

7. The weldment connector as described in claim 6, further comprising a weldment being applied between said proximate and opposing faces plates of said first and second connectors.

8. The weldment connector as described in claim 1, each of said first and second connectors having specified length, height and thickness, and further comprising a plurality of spaced apart and parallel extending reinforcing bars and a wire meshing embedded within and extending therebetween the first and second slabs of concrete.

9. A weldment connector comprising:

an elongated and planar shaped front face; and a first leg and a second leg, each of said legs exhibiting a height and thickness substantially equal to that of said front face and being integrally formed with opposite end locations of said front face, said legs extending in an angled and combined axial/rotationally offset manner relative to said front face.

10. A weldment connector, comprising:

an elongated and planar shaped front face having a specified length, height and thickness;

a first leg and a second leg extending from opposite end locations of said front face, each of said legs having a height and thickness common to said front face and extending in both a combined and continuos angular and rotationally offset manner relative to said front face and along axial directions of said legs; and undulated portions being defined proximate and short of terminating end locations of said first and second legs.

* * * * *